US011940229B2

(12) United States Patent
Theobald et al.

(10) Patent No.: US 11,940,229 B2
(45) Date of Patent: Mar. 26, 2024

(54) HEAT EXCHANGER

(71) Applicant: HYDAC COOLING GMBH, Sulzbach/Saar (DE)

(72) Inventors: Benjamin Theobald, Saarlouis (DE); Thomas Wolfanger, Neunkirchen (DE); Ditmar Georgi, Kirkel (DE)

(73) Assignee: HYDAC COOLING GMBH, Sulzbach/Saar (DE)

( * ) Notice: Subject to any disclaimer, the term of this patent is extended or adjusted under 35 U.S.C. 154(b) by 217 days.

(21) Appl. No.: 17/424,963

(22) PCT Filed: Oct. 28, 2019

(86) PCT No.: PCT/EP2019/079421
§ 371 (c)(1),
(2) Date: Jul. 22, 2021

(87) PCT Pub. No.: WO2020/160800
PCT Pub. Date: Aug. 13, 2020

(65) Prior Publication Data

US 2022/0120508 A1 Apr. 21, 2022

(30) Foreign Application Priority Data

Feb. 7, 2019 (DE) ..... 10 2019 000 922.3

(51) Int. Cl.
*F28D 9/00* (2006.01)
*F28F 9/02* (2006.01)

(52) U.S. Cl.
CPC ..... *F28D 9/0068* (2013.01); *F28D 9/00* (2013.01); *F28F 9/0282* (2013.01)

(58) Field of Classification Search
CPC ..... F28D 9/0068
See application file for complete search history.

(56) References Cited

U.S. PATENT DOCUMENTS 307,480 A * 11/1884 Luttgens ..... F23B 30/02 165/174
1,409,967 A * 3/1922 Prat ..... F28D 9/0062 165/166

(Continued)

FOREIGN PATENT DOCUMENTS

DE 31 09 955 9/1982
DE 31 40 408 4/1983

(Continued)

OTHER PUBLICATIONS

Translation of German Patent Document DE202004011489U1 entitled Translation—DE202004011489U1 (Year: 2023).*

(Continued)

*Primary Examiner* — Paul Alvare
(74) *Attorney, Agent, or Firm* — WENDEROTH, LIND & PONACK, L.L.P.

(57) ABSTRACT

A heat exchanger has a plurality of rows of media guiding ducts (12) for passing a media flow, a plurality of rows of fluid ducts for passing fluid to be temperature-controlled, and strip-shaped flow profile parts (20). At a transition between guide parts of the flow profile parts (20) and their plug-in parts, two mutually opposite steps are formed. The steps allow the flow profile part (20) to sit on the adjacent end faces of a fluid duct without spacing. The flow profile part (20) does not project at any point into a free opening cross section, which is defined by the imaginary extension of the inner, mutually facing boundary walls of a media duct (12) and by a media inlet of this duct (12).

7 Claims, 2 Drawing Sheets

(56) References Cited

U.S. PATENT DOCUMENTS

| | | | | | |
|---|---|---|---|---|---|
| 2,288,598 | A * | 7/1942 | Ramsaur | F28D 7/0058 165/162 |
| 5,832,993 | A * | 11/1998 | Ohata | F28F 13/06 165/DIG. 387 |
| 10,801,790 | B2 * | 10/2020 | Streeter | B33Y 80/00 |
| 2004/0035562 | A1 * | 2/2004 | Nishijima | F28F 13/06 165/177 |
| 2013/0168045 | A1 * | 7/2013 | Schmid | F28F 9/0282 165/96 |
| 2015/0276330 | A1 | 10/2015 | Rigaudie et al. | |
| 2018/0334952 | A1 * | 11/2018 | Concialdi | F28D 9/0062 |
| 2022/0018612 | A1 * | 1/2022 | Wolfanger | F28D 1/05366 |

FOREIGN PATENT DOCUMENTS

| | | | | |
|---|---|---|---|---|
| DE | 39 26 283 | | 2/1991 | |
| DE | 20 2004 011 489 | | 12/2005 | |
| DE | 202004011489 | U1 * | 1/2006 | F28D 1/0366 |
| DE | 10 2010 046 913 | | 3/2012 | |
| DE | 10 2011 105 968 | | 1/2013 | |
| GB | 326981 | A * | 3/1930 | |
| GB | 634608 | A * | 10/1947 | |
| JP | 2005016838 | A * | 1/2005 | F28D 1/0435 |
| JP | 2010275982 | A * | 12/2010 | |
| WO | 2014/053712 | | 4/2014 | |

OTHER PUBLICATIONS

International Search (ISR) dated Feb. 19, 2020 in International (PCT) Application No. PCT/EP2019/079421.

* cited by examiner

HEAT EXCHANGER

FIELD OF THE INVENTION

The invention relates to a heat exchanger, comprising at least a plurality of rows of media guiding ducts for passing a media flow along their inner, mutually facing boundary walls and a plurality of rows of fluid ducts for passing fluid to be temperature-controlled. The fluid ducts are at least in part located in pairs opposite from each other and accommodate at least one row of media guiding ducts between each other. At least one of the free rectangular end faces of the media guiding ducts without coating form a media inlet. At least some of the fluid ducts have a deflector device, which routes contaminant particles entrained in the medium at least in part away from the fluid ducts in the direction of the media ducts. The deflector device is formed by a strip-shaped flow profile part, which is arranged on the free end face of an assignable fluid duct and closes the that fluid duct outwards towards the environment and projects beyond the fluid duct. The deflector device has a guide part and a plug-in part, which is in one piece connected to the guide part and is inserted into the respective assignable fluid duct.

BACKGROUND OF THE INVENTION

Heat exchangers, which routinely operate as liquid-air heat exchangers, are state of the art, see for instance DE 10 2010 046 913 A1. To achieve the cooling capacities required for the individual applications, air-liquid coolers are usually operated as active coolers having cooling fans that generate the air flow required for an effective heat exchange in the air ducts. To increase the effective heat transfer surface, heat exchangers of this type have cooling fins in their air guiding ducts, preferably in the form of meandering fins made of thin aluminum sheet. When heat exchangers of this type are operated in dust-laden air, particles accumulate on the surfaces facing the air flow. The progressive accumulation of particles results in the air path becoming clogged and in an increased pressure drop, which can no longer be compensated by the blower, causing the air volume, flowing through the air ducts, and consequently the heat transfer to decrease drastically.

DE 31 40 408 A1 also describes a heat exchanger, in particular for use in an internal combustion engine. The heat exchanger is formed in flat tube design, fin design or plate design and through which air flows as a cooling medium. In front of the cooling air inlet end of the heat exchanger, a replacement mockup, having the same lattice structure, as the heat exchanger is arranged. Plug-in parts are used to close the associated media ducts at the end. The plug-in parts are flush with the rectangularly arranged end faces of the respective media duct. The replacement mockup, with its individual flow profile parts, is placed in front of the plug-in parts. For the purpose of routing the air flow, its parabolically shaped guide parts project into the free opening cross section of the air-conveying fluid duct, each arranged adjacent to a media duct.

DE 31 09 955 A1 describes a generic plate heat exchanger having intermediate layers arranged between the plates in a zigzag shape. Each layer is arranged alternating on two edges, opposite to each other, of the plates and flush with the plates, except for the protruding parts. The plates delimit flow ducts for the cross-guiding of heat exchange media, one of which is gaseous, such as air. To reduce the accumulation of dirt on the incident-flow end, exposed to the gaseous heat exchange medium, of the heat exchanger, this end is provided with a plastic coating. The plastic coating has a uniformly smooth surface, which, on the part of the surface, immediately succeeding the incident-flow end, ends at an inclination preventing flow separation. This plastic coating evens out the roughness resulting from the manufacture of the parts of the heat exchanger.

DE 39 26 283 A1 describes another generic recuperative hollow-chamber plate heat exchanger with aerodynamic incident-flow and outgoing-flow surfaces that are part of flow profiles, plugged-in as separator webs in the end faces of adjacent hollow-chamber plates of the known heat exchanger. The use of hollow-chamber plates in the known solution replaces previous forms of individual sheet metal plates, which are canted against each other, and can vibrate more or less permanently. The flow profile parts referred to, which with their guide parts protrude from the hollow chamber plates and apart from that with their plug-in parts, are connected in one piece to the guide parts, are permanently plugged-in into the hollow chamber plates, and achieve a permanent calibration. The incident-flow surfaces for the flow profile parts are fluidically designed such that the pressure loss of the medium on entering and exiting the heat exchanger is only slight.

SUMMARY OF THE INVENTION

In view of this state of the art, the invention addresses the problem of providing a heat exchanger, which, in comparison, is characterized by a more favorable operating behavior.

According to the invention, this problem is basically solved by a heat exchanger of the type mentioned at the outset in that, at the transition between the guide part and the plug-in part, two mutually opposite steps are formed, which steps allow the flow profile part to sit on the adjacent end faces of a fluid duct without spacing. Also, the flow profile part does not project at any point into a free opening cross-section, which is defined by the imaginary extension of the inner, mutually facing boundary walls of a media duct and by the media inlet. In this way, the free incident flow of the media flow, which may be loaded with contaminants, such as dust-laden air, is not impeded by any flow profile parts, because their media conveying guide parts leave the propagated incident flow space completely empty, which is prespecified by the imaginary duct extension of the respective media duct. In particular, turbulence, that could impede the media (air) entrance, is prevented in this way, and improved dirt rejection and dirt accumulation by the guide parts or at the guide parts with their guide surfaces are achieved. In this respect, the solution according to the invention also manages entirely without a coating in the context of flow routing, which contributes to reducing costs, prevents unnecessary vibrations during operation and does not impair free flow routing.

Because of the integral design of the flow profile parts with their plug-in and guide parts, they can be manufactured cost-effectively in a continuous casting process or an extrusion molding process, and the fluid ducts are braced, in particular at their free end faces, which also increases the overall stability of the heat exchanger. Another factor in aid thereof is at the transition between the guide part and the plug-in part of a flow profile part where two mutually opposite steps are formed, with a matching widening of the diameter towards the guide part. The flow profile part is seated via the steps on the adjacent end faces of a fluid duct without spacing, and therefore in a sealing manner. In this respect, sealing problems in this area are reliably prevented, and the flow profile part can be supported against the direction of flow of the media (air) at the end faces of the reference walls of the respective fluid duct across the entire surface(s).

The deflector device according to the invention can be used to route the contaminant particles entrained in the medium, such as air, away from the fluid ducts in the direction of the media guiding ducts. The guide function of the deflector, which influences the flow of the media, fosters the removal of contaminant particles via the media ducts. Compared to otherwise known deflector-free and therefore flat incident-flow surfaces facing the media flow, this arrangement impedes the accumulation of contamination particles to achieve an increased operational reliability for dust-laden media such as air, while reducing the risk of blockage. When particles are referred to as contaminants, this includes fibers of any kind, also in the form of plant fibers and the like as they occur when material is chopped and can easily occur in agricultural applications of the heat exchanger with assigned working machines.

The fluid channels can also contain liquids to be cooled or temperature-controlled, such as water-glycol mixtures, lubricants and fuels including transformer oils and HFC liquids, etc. In principle, however, it is also possible to heat such liquids in the fluid ducts by gaseous, liquid or paste-like media in the media ducts as part of temperature control. Also, hot gases, such as hot process gases, routed in the media ducts can be cooled by cooling fluids in the fluid ducts. The assigned media guiding ducts and fluid ducts can separate gas/gas, gas/liquid, liquid/gas, and liquid/liquid from each other and permit a temperature exchange in the direction of assimilation of medium and fluid. The respective medium mentioned can also be gas mixtures and mixtures with liquids. Liquids can also have gaseous components. Furthermore, the use of paste-like or pasty media is possible in context of the heat exchanger arrangement.

The deflector device is formed by at least one flow profile part, which is arranged at the free end face of the assignable fluid duct and which closes off the fluid duct towards the outside from the surroundings and projects above thereof. Advantageously, the respective flow profile part for the assigned fluid duct can form a closing part sealing the front end of the closing part, preferably in the form of the insert part or plug-in part.

The respective flow profile part can advantageously have at least one guide surface, which routes the media flow in the direction of the media inlet to at least one adjacent media duct.

The arrangement can advantageously be made such that the guide surface of the respective flow profile part is formed to be flat, curved or stepped in sections. The geometry can advantageously be adapted to the conditions of the different applications of the heat exchanger, for example, to the nature of the dirt particles burdening the media flow, to the dimension of the ducts and the like.

With particular advantage, two guide surfaces of a flow profile part can be formed to extend towards each other on the end facing away from the assignable fluid duct. The resulting reduction in the cross-sectional area in the front pressure area of the flow section parts, facing the media flow, results in a low flow resistance of the deflector device.

In particularly advantageous exemplary embodiments, two guide surfaces of a flow profile part are formed at an acute angle to each other. As a result, a particularly effective outgoing-flow of the dirt particles can be achieved with a particularly low flow resistance generated by the pointed shape.

In preferred exemplary embodiments, the fluid ducts each open out on both sides into a collecting space. The media guiding ducts are delimited by fins, which extend in a row arrangement at least partially between the adjacent fluid ducts. The flow guiding bodies extend continuously in the form of strips from one collecting space to the next. The arrangement can advantageously be made such that, at least during operation, the fluid ducts extend horizontally between the collecting chambers and such that the fins, in particular in a zigzag arrangement, delimit the media ducts. The vertically extending collecting chambers can be hollow boxes forming the struts of the stand of a rectangular structure in which the incident-flow surface is spanned between the collecting chambers. However, the hollow box formed in this way does not necessarily have a square cross-section. The deflector device can be an integral part of the heat exchanger. However, it is also possible to place the deflector device in front of the media inlet of the heat exchanger as an independent add-on part conceived similar to a front mounting frame.

The object of the invention is also a deflector device, which is provided in particular for a heat exchanger according to the invention.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure.

DETAILED DESCRIPTION OF THE INVENTION

Figure 1:
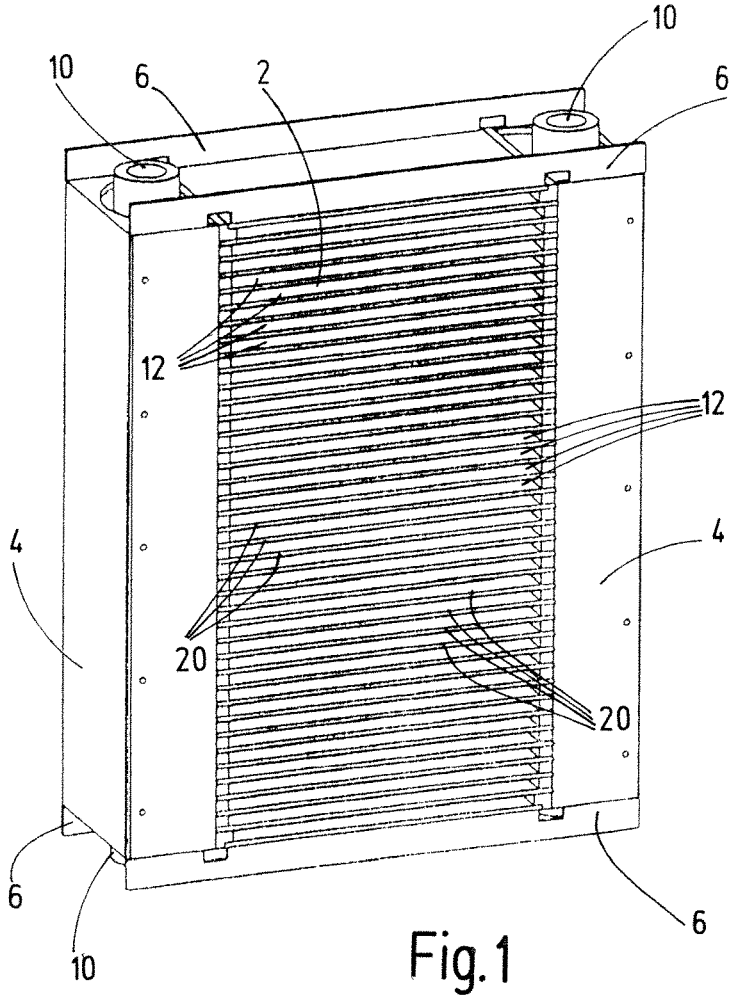
FIG. 1 is a perspective view of a heat exchanger according to a first exemplary embodiment of the invention, viewed in the direction of the media incident-flow end.

The exemplary embodiments of the heat exchanger, shown in FIGS. 1 to 5, has, as shown in FIG. 1, an end face 2 exposed to the media flow, such as an air flow, and having a rectangular outline. On both sides of the end face 2, main struts 4 form an adjoining support structure, Each main strut 4 is shaped as a web forming a hollow box having a square or any other cross-section and forms a collecting space for a liquid fluid, in this case transporting heat. The fluid can be a cooling liquid, such as a water-glycol mixture, or a liquid to be cooled, such as hydraulic oil. At the upper and lower ends, the struts 4 are interconnected by support strips 6, of which two front strips 6 are extending in the plane of the front face 2 and two rear strips 6 are extending in the plane of the rear face 8 of the heat exchanger. Ports 10 are arranged at the ends of the struts 4 for the inflow and outflow of the fluid into and out of the collecting chambers. Instead of a cooling liquid as fluid, however, a thermal fluid, thus a heated fluid, can also be used to heat the same.

In the usual manner for such heat exchangers and as shown in the aforementioned document DE 10 2010 046 913 A1, superposed rows of air or media ducts 12 (see FIGS. 4 and 5) are provided between the struts 4. Fluid ducts 14 are located between the media ducts 12, with each fluid duct being connected to the collection chambers in the struts 4 in a fluid conveying manner or in fluid communication. The fluid ducts 14 are each separated from the air ducts 12 by plane plates 16. In the manner also usual for heat exchangers of this type, to increase the heat transfer surface in the media ducts 12, fins are provided in a preferably zigzag arrangement, which fins are omitted in present drawing of FIGS. 4 and 5. In the exemplary embodiments shown here, for instance, 37 media ducts 12, of which are only a part is numbered in FIG. 1, are provided, which media ducts extend in horizontal planes between the struts 4 when the heat exchanger is set up on the lower strips 6.

Figure 2:
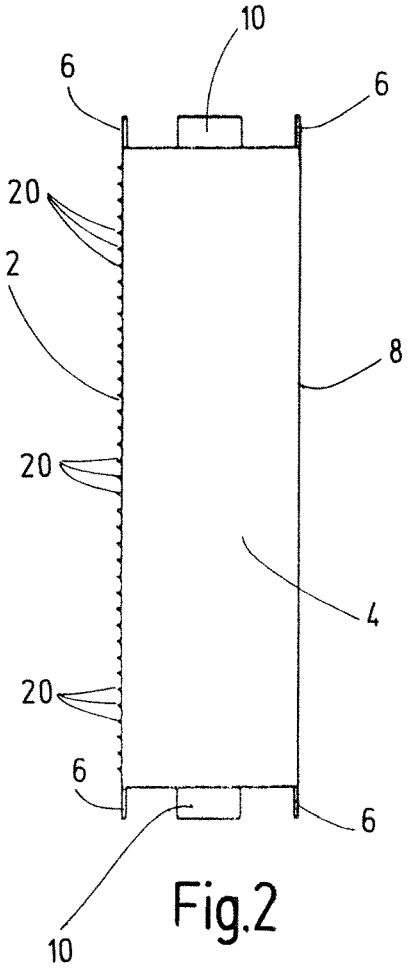
FIG. 2 is a side view of the first exemplary embodiment.
Figure 3:
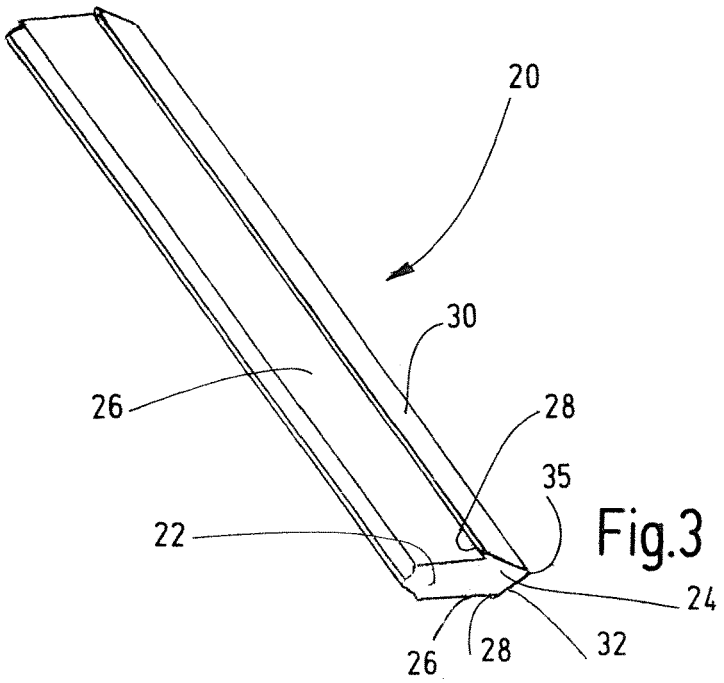
FIG. 3 is a perspective view of the separately shown flow guide profile part of the first exemplary embodiment.
Figure 4:
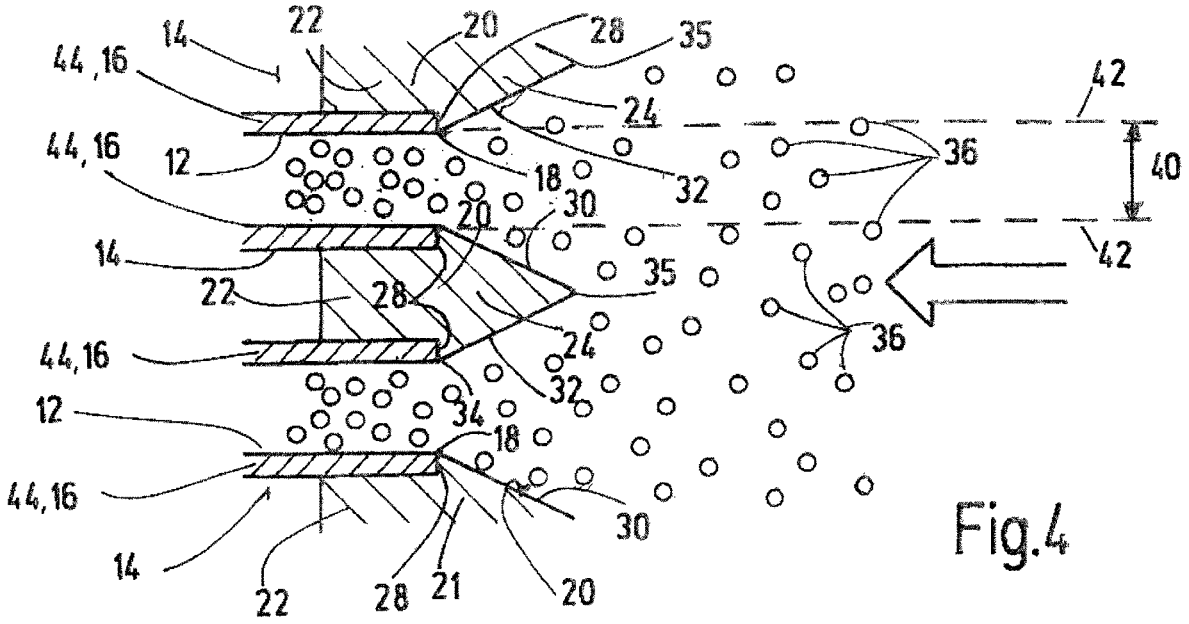
FIG. 4 is a highly schematic, simplified partial sectional side view of the air entrance area of the first exemplary embodiment, wherein the course of the media flow, influenced by the flow profile parts, is shown by symbolically indicated contamination particles.
Figure 5:
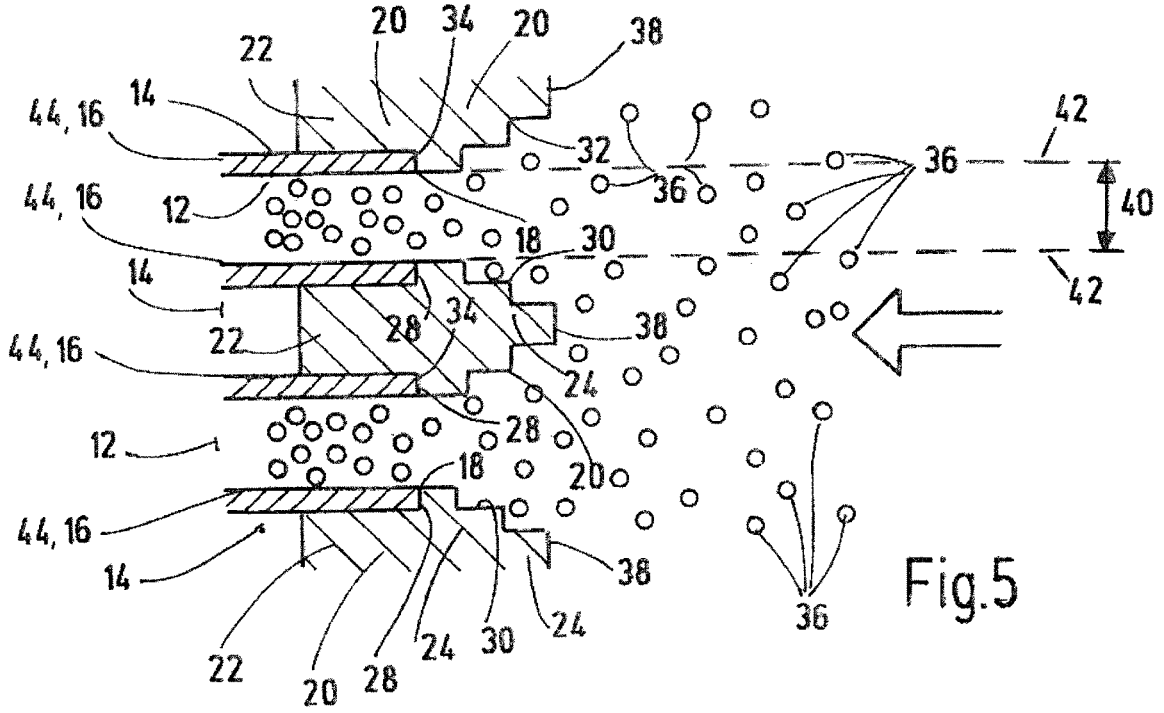
FIG. 5 is a highly schematic, simplified partial sectional side view of an air entrance area of a heat exchanger according to a second exemplary embodiment of the invention.

As shown in FIGS. 4 and 5, a deflector 20 is arranged at the media or air inlet 18 of each media duct 12, forming a flow profile part, around which the incoming media flow flows in the exemplary embodiments and only partially is numbered in FIGS. 1 and 2. As shown in FIG. 3, in which a single deflector or flow profile part 20 is shown. The flow profile parts 20 are each formed by a profile strip extending in one piece between the struts 4. The profile of each flow profile part 20 has a foot part or plug-in part 22 and an adjoining head part or guide part 24. The plug-in part 22 has the form of a flat band having flat, parallel lateral surfaces, which are plugged into the ends of the fluid ducts 14 in a well-fitting manner, wherein the plug-in part 22 forms the fluid-tight end closure of the fluid ducts 14. At the transition of the plug-in part 22 to the guide part 24, the flow profile part 20 is extended by a step 28, see FIG. 3, which in the inserted state, see FIG. 4, reaches flush over the end edges 34 at the media inlet or air inlet 18 of the plates 6 towards the outside, see FIGS. 4 and 5, in a flush-fitting manner. With its both lateral surfaces, extending from the two opposite steps 28, the guide part 24 forms guide surfaces 30 and 32 each, which is laterally inclined, converge in a planar manner, and unite in a point 35. In that way, the flow profile parts 20 form rows of pointy tapered ribs, whose cross-section corresponds to an acute triangle and which project outwards out of the plane of the incident-flow surface at the end face 2 of the heat exchanger, which end face is defined by the plane of the media inlets or air inlets 18. As shown in FIG. 4, in which contamination particles are symbolically indicated and designated by the numeral 36, the guide surfaces 30 and 32 deflect the particles 36, entrained in the media flow, from the direction of flow towards the media inlets 18, thereby promoting particle removal through the guide ducts 12 and simultaneously reducing the risk of buildup at the inlet 18.

FIG. 5 shows an exemplary embodiment having, compared to the first exemplary embodiment, a modified profile contour of the guides 24 of the flow profile parts 20. As in the first exemplary embodiment, the foot part and plug-in part 22 forms the end closure of the fluid ducts 14, wherein, as in the previous exemplary embodiment, the steps 28, extending the profile width, reach over the end edges 34 of the plates 16. The guide parts 24, which in turn project forward from the plane of the end face 2 having the inlets 18, also have the converging lateral guide surfaces 30 and 32, as in the first exemplary embodiment. However, these have a stepped course. They end, instead of in the tip 35, in a narrow end surface 38. In the exemplary embodiment shown in FIG. 5, the guide surfaces 30 and 32 are stepped twice having the same step height. The width of the end surface 38 is approximately ¼ of the profile width of the guide part 24.

Just as the media guide ducts 12 have zigzag-shaped or meandering fins for improved flow guiding and heat exchange, there can also be flow guides of comparable construction in the fluid ducts 14 for flow guiding of the fluid, viewed in the direction of the incident flow. It is also possible to form the free end face of the deflector device 20 as a calotte when viewed in cross-section. Particularly preferably, the free end face of the fluid duct 14 can be closed by an adapter mount, which allows different types of profiles to be used interchangeably on the heat exchanger 1. it is also possible depending on the specifications to exchange differently formed profile cross-sections using the adapter (not shown).

As FIGS. 4 and 5 further show, the imaginary extensions 42 of the inner boundary walls 44, facing each other, of a media guiding duct 12 together with the associated media inlet 18 form across the width of the heat exchanger a substantially rectangular incident-flow space, which is left clear of the flow profile parts 20. In particular, none of the guide surfaces of the flow profile parts 20 extend into the flow space defined, so that the free entrance flow into the respective media guiding duct 12 is not impaired.

While various embodiments have been chosen to illustrate the invention, it will be understood by those skilled in the art that various changes and modifications can be made therein without departing from the scope of the invention as defined in the claims.

The invention claimed is:

1. A heat exchanger, comprising;

a plurality of rows of media guiding ducts arranged to pass a media flow along inner, mutually facing boundary walls thereof;

a plurality of rows of fluid ducts arranged to pass fluid to be temperature-controlled, the fluid ducts being at least in part located in pairs spaced from each other and accommodating at least one row of the media guiding ducts between the fluid ducts of the pairs;

a free rectangular end face without a coating forming a rectangular media inlet exposed to a media flow, each of two opposite sides of the end face having first and second main struts each forming a support structure and being a hollow box forming a collection chamber for a liquid to transport heat, opposite axial ends of the fluid ducts opening in fluid communication with an inside of the respective collection chamber;

at least some of the fluid ducts having deflectors capable of routing contaminant particles entrained in medium flow through the end face at least in part away from the fluid ducts in directions of the media guiding ducts, each of the deflectors being formed by an elongated flow profile part being arranged on a free end face of the respective fluid duct, closing the respective fluid duct outwardly towards an environment and projecting beyond the respective fluid duct, each of the flow profile parts also including a guide part and a plug-in part connected in one piece to the guide part and inserted into the respective fluid duct, the guide part of each of the flow profile parts projecting forwardly from a plane of a free end face of inlets of the media guiding ducts and having converging lateral surfaces extending along a stepped course and ending in a narrow end surface; and two mutually opposite steps being formed at the transition between the guide part and the plug-in part of each of the flow profile parts allowing the flow profile part to sit on the adjacent end faces of the respective fluid duct without spacing, each of the flow profile parts not projecting at any point into a free opening cross section defined by an extension of inner, mutually facing boundary walls the respective media duct and by the media inlet.

2. The heat exchanger according to claim 1 wherein the converging lateral surfaces are arranged to route the media flow in the direction of the media inlet to at least an adjacent one of the media guiding ducts.

3. The heat exchanger according to claim 1 wherein the converging lateral surfaces of the respective flow profile part are flat.

4. The heat exchanger according to claim 1 wherein the converging lateral surfaces of each of the flow profile parts narrow the respective guide part in a direction extending away from the respective fluid duct along an entire length of the respective guide part from the inlet of the respective media guiding duct to the narrow end surface.

5. The heat exchanger according to claim 1 wherein the free rectangular end face is directly exposed to the environment without any covering.

6. The heat exchanger according to claim 1 wherein the media guiding ducts are delimited by fins, which extend in rows arranged at least partially between adjacent ones of the fluid ducts.

7. The heat exchanger according to claim 6 wherein at least during operation, the fluid ducts extend horizontally between the collecting chambers, and the fins delimit in a zig-zag arrangement on the media ducts.

* * * * *